US005489219A

United States Patent [19]

Fabian

[11] Patent Number: 5,489,219

[45] Date of Patent: Feb. 6, 1996

[54] SELF-RETAINING BOARD LOCK

[75] Inventor: David J. Fabian, Mount Joy, Pa.

[73] Assignee: The Whitaker Corporation, Wilmington, Del.

[21] Appl. No.: 248,262

[22] Filed: May 24, 1994

[51] Int. Cl.[6] ..... H01R 13/60

[52] U.S. Cl. ..... 439/567; 439/554; 439/329

[58] Field of Search ..... 439/552–555, 439/567, 571–572, 329

[56] References Cited

U.S. PATENT DOCUMENTS

| | | | |
|---|---|---|---|
| D. 299,004 | 12/1988 | Fujimoto | D8/382 |
| 3,577,603 | 5/1971 | Seckerson | 24/73 |
| 3,659,243 | 4/1972 | Guntz . | |
| 3,778,755 | 12/1973 | Marks . | |
| 4,186,982 | 2/1980 | Cobaugh et al. . | |
| 4,435,031 | 3/1984 | Black et al. . | |
| 4,457,570 | 7/1984 | Bogese, II . | |
| 4,461,537 | 7/1984 | Raymer, II et al. | 350/96.2 |
| 4,477,142 | 10/1984 | Cooper et al. . | |
| 4,495,548 | 1/1985 | Matsui | 361/413 |
| 4,618,915 | 10/1986 | Bury | 361/400 |
| 4,639,066 | 1/1987 | Shimamiya et al. . | |
| 4,641,901 | 2/1987 | Brennan et al. . | |
| 4,645,287 | 2/1987 | Olsson | 439/83 |
| 4,679,883 | 7/1987 | Assini et al. | 439/607 |
| 4,693,532 | 9/1987 | Colleran et al. | 439/594 |
| 4,703,991 | 11/1987 | Philippson | 439/676 |
| 4,717,219 | 1/1988 | Frantz et al. | 439/82 |
| 4,721,473 | 1/1988 | DelGuidice et al. | 439/79 |
| 4,723,059 | 2/1988 | Nelson et al. | 200/277 |
| 4,735,587 | 4/1988 | Kirayoglu | 439/751 |
| 4,820,180 | 4/1989 | Mosquera et al. | 439/248 |
| 4,821,152 | 4/1989 | Lorenzen | 361/403 |
| 4,824,398 | 4/1989 | Taylor | 439/557 |
| 4,841,100 | 6/1989 | Ignasiak | 174/136 G |
| 4,842,552 | 6/1989 | Frantz | 439/557 |
| 4,847,588 | 7/1989 | Doutrich | 439/751 |
| 4,865,555 | 9/1989 | Assini et al. | 439/82 |
| 4,907,987 | 3/1990 | Douty et al. | 439/571 |
| 5,080,611 | 1/1992 | Hypes | 439/554 |
| 5,115,349 | 5/1992 | Fuse | 358/709 |
| 5,135,412 | 8/1992 | Sitzler | 439/571 |
| 5,145,407 | 9/1992 | Obata et al. | 439/567 |
| 5,145,408 | 9/1992 | Houtteman et al. | 439/581 |
| 5,154,634 | 10/1992 | Brown et al. | 439/553 |
| 5,161,999 | 11/1992 | Broschard, III et al. | 439/567 |
| 5,163,851 | 11/1992 | Hart et al. | 439/567 |
| 5,176,349 | 1/1993 | Bendorf | 248/220.2 |

(List continued on next page.)

FOREIGN PATENT DOCUMENTS

| | | |
|---|---|---|
| 0180284A2 | 7/1986 | European Pat. Off. . |
| 2386963 | 3/1978 | France . |
| 7914042 | 5/1979 | Germany . |
| 40-22823 | 4/1965 | Japan . |
| 51-83793 | 7/1976 | Japan . |
| 1128404 | 9/1968 | United Kingdom . |
| 2058485A | 4/1981 | United Kingdom . |
| 2239135 | 6/1991 | United Kingdom . |

OTHER PUBLICATIONS

The Whitaker Corporation Case No. 15805, Ser. No. 08/217,045.

*Primary Examiner*—David L. Pirlot
*Assistant Examiner*—Jill DeMello
*Attorney, Agent, or Firm*—Katherine Nelson

[57] ABSTRACT

A board lock device 10 holding an electrical connector 40 to a one-piece essentially planar board lock member adapted to be received in a passageway 48 extending through a connector housing 40 and a board mounting post 50 extending from a mounting face 46 thereof includes a body 12 and a pair of cantilevered beams 18 extending outwardly in a first direction in the plane from a transverse body edge 14 to free ends 24. The beams 18 defining a slot 36 therebetween. The board mounting post 50 includes a protrusion 54 extending into the passageway 48 at least at the leading end 52 thereof. The inner edges 28 of the beams 18 are adapted to enter into locking engagement with the protrusion 54 upon full insertion of the device 10 into the passageway 48 to prevent any backward movement of the device when the connector 40 is mounted to a circuit board 60.

10 Claims, 5 Drawing Sheets

U.S. PATENT DOCUMENTS 5,184,963 2/1993 Ishikawa ..... 439/79
5,213,515 5/1993 Ishikawa et al. ..... 439/79
5,228,870 7/1993 Gorenc et al. ..... 439/567
5,238,413 8/1993 McCaffrey et al. ..... 439/79
5,316,500 5/1994 Vanaleck et al. ..... 439/567
5,322,452 6/1994 Mosquera ..... 439/571

SELF-RETAINING BOARD LOCK

FIELD OF THE INVENTION

This invention relates to a mounting device for locking or securing components such as electrical connectors to circuit boards.

BACKGROUND OF THE INVENTION

There are numerous ways of securing an electrical connector to a circuit board. For example, the connector may be provided with mounting ears having bores for accepting threaded mounting bolts which extend through corresponding apertures of the circuit board and are secured by nuts on the opposite side of the board.

U.S. Pat. Nos. 5,184,963 and 5,213,515 disclose top loaded board locks which are inserted into flanges or other areas of the housing from the surface opposite the board mounting face of the connector. When mounting such connectors to circuit boards, it is necessary to use a tool or other surface to apply force directly to the board lock members to insert them into the circuit board apertures so that the board lock devices will not move backwardly out of the connector housing in response to resistance to insertion into the circuit board apertures. It is desirable, therefore, to have a board lock member that is self-retaining in the housing and does not require use of a special insertion tool.

One such approach is disclosed in U.S. Pat. No. 5,228,870 wherein a portion of a board lock device is captured in a cavity of the housing entered from the connector mounting face and a second portion of the device is inserted into the board aperture. The portions are provided with barbs and the recess and board aperture are sized for an interference fit with the barbs. The housing structure above the cavity provides a backing surface for the board lock device during mounting of the connector.

U.S. Pat. No. 5,176,349 disclosed a further approach in which the housing includes an integrally molded post adapted to be received in a circuit board aperture. The post has a cavity in which a resilient retaining member can be inserted from a direction that is transverse to the longitudinal axis of the post. The housing provides a backing surface for the retaining member when the connector or other component is mounted to a circuit board. A disadvantage of this type of retaining member is that a double draw mold is required to form the housing and post configuration, thereby adding to the cost of manufacturing the product. The assembly of the resulting connector will also require additional steps since the terminal members typically would be inserted into the housing from a different direction than that required for the retaining member.

With todays increased emphasis on automated manufacturing procedures it is generally desirable to have a board lock device that is loaded into a connector housing from the same direction in which the terminal members are loaded. For example when top loading terminal members into a housing it is desirable to use a board mount device that is top loaded into the connector. It is further desirable that the connector be able to be mounted without having to use specialized tools specifically for the board lock member.

SUMMARY OF THE INVENTION

Accordingly, the board lock or holding device of the present invention is a planar member that is top loaded into a connector housing and once inserted into the housing is self-retaining, therein, that is, it is held securely in the housing such that the locking engagement is sufficient to prevent backward movement of the holding device when the connector is mounted to the board. The holding device of the present invention is a one-piece essentially planar metal member having a body and a pair of cantilevered beams extending in a first direction in the plane from the body to free ends. The beams have outer and inner edges defining a slot therebetween. The inner edges of the beams further include latching portions proximate the free ends thereof that engage a transverse locking surface at the leading end of a mounting post extending from the mating face of the connector housing. Each of the outer edges of the beams further include board engaging portions that extend outwardly from the mounting posts. When the connector is mounted to the board the board engaging portions of the holding device engage the wall surfaces of the circuit board apertures thereby securing the connector to the board.

The device of the present invention is mountable in a board holding device passageway that extends from a surface opposed to the mounting face of the connector and through a corresponding board mounting post that extends from the mounting face of the connector housing. Board mounting posts, as known in the art are typically used to align connectors on a circuit board so that the corresponding connector terminals and circuit pads or through-hole apertures of a circuit board are aligned prior to full insertion of the connector. The board lock in the present invention in combination with the aligning or mounting posts provides a means whereby the connector can be aligned on the board as well as secured to the board. This is particularly useful when the devices are used with connectors having terminal leads that are to be received in corresponding circuit board apertures.

In the preferred embodiment, the board holding device passageway of the housing extends from the upper surface of the housing and into the mounting post. The mounting post is formed as a pair of semicylindrical legs joined at least at the leading ends thereof and includes slots therebetween at least along side portions. In the preferred embodiment, the semicylindrical legs are joined by center rib that is tapered inwardly from the leading end to the top of the post, the rib being substantially the same length as the slot between the cantilevered beams of the board lock device. The inner edges of the board lock device include inwardly directed projections defining latching sections at the leading ends thereof which engage along the bottom edge of the center rib when the board lock device is fully inserted into the housing passageway. The total width of the cantilevered beam portion of the board lock device is greater than the width of the mounting post thereby permitting the barbs on the outer edge of the beams to extend outwardly of the slots between the pair of semicylindrical legs.

It is an object of the present invention to provide a mounting board lock device for mounting electrical connectors to a circuit board wherein the board lock is self-retaining in the housing structure prior to mounting to the board.

It is a further object of the invention to provide a board lock device that can be top loaded in a connector housing and the connector be mounted to the board without the need for specialized tools to insert the board locking device.

It is another object of the invention to provide a connector and self-retaining board lock assembly wherein the connector housing can be molded in a single draw mold.

Embodiments of the present invention will now be described by way of example with reference to the accompanying drawings.

DETAILED DESCRIPTION OF THE DRAWINGS

Figure 1:
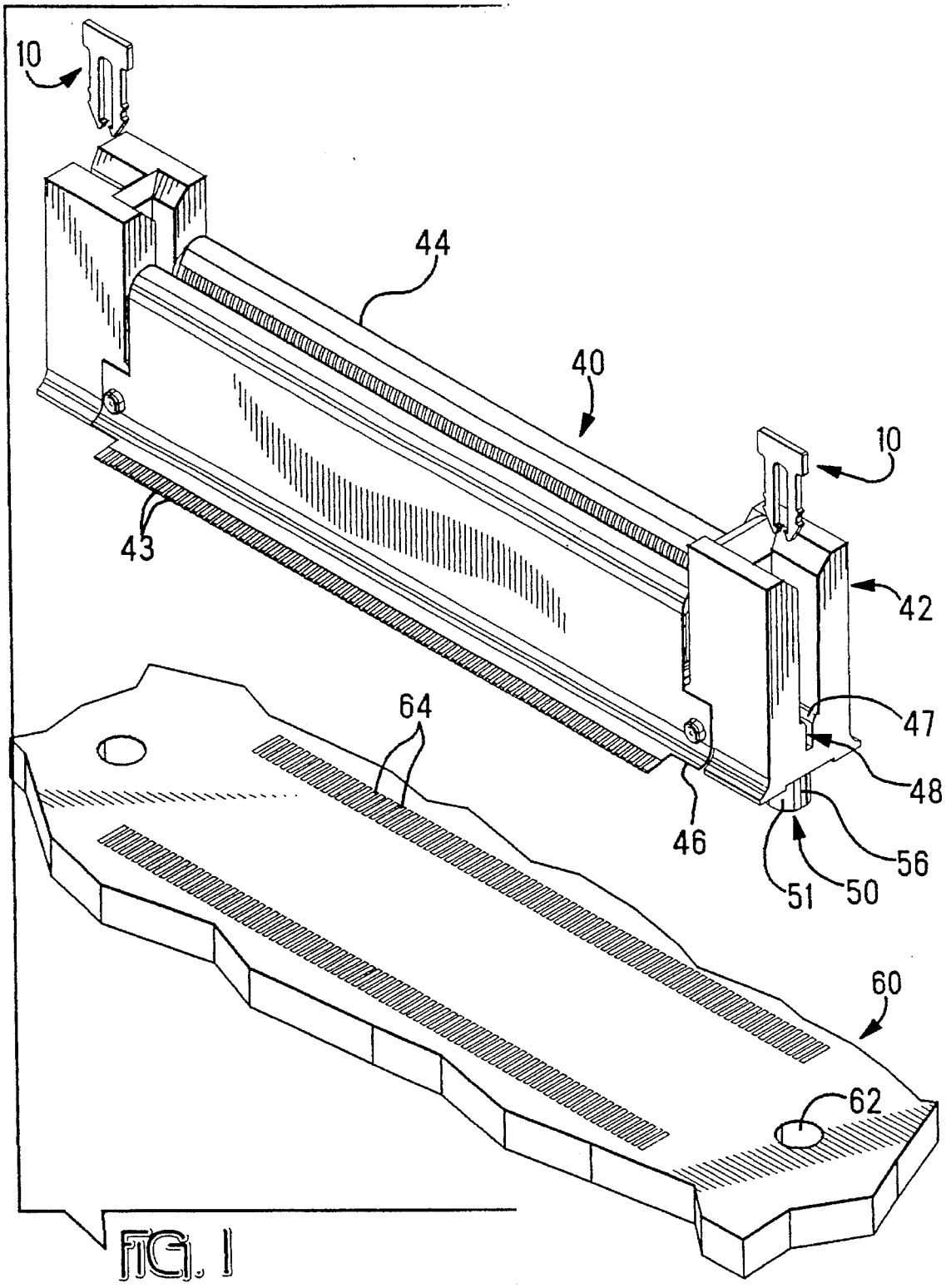
FIG. 1 is a perspective view of an assembled electrical connector having two of the holding devices of the present invention exploded from the connector housing and the connector exploded from a circuit board.
Figure 2:
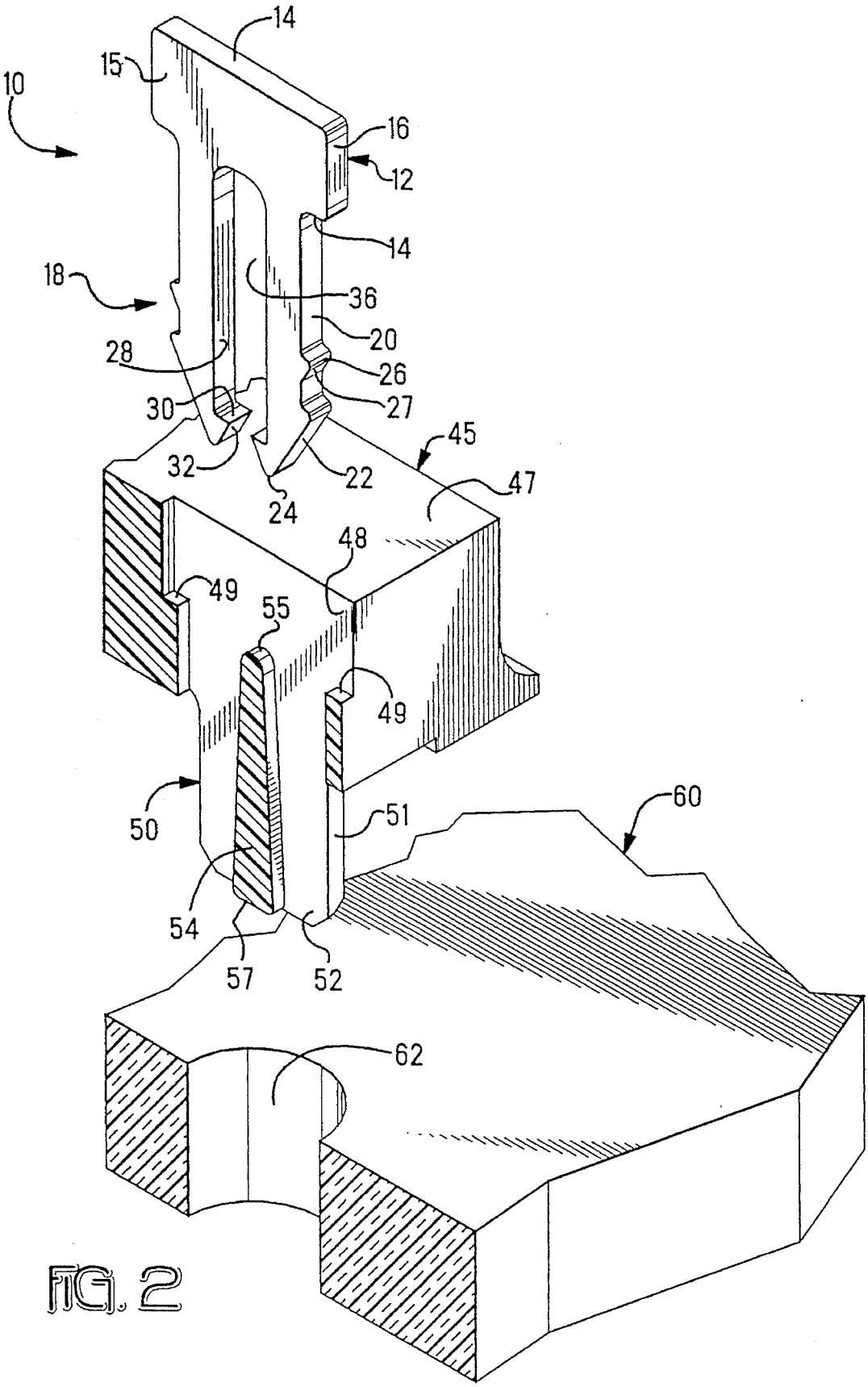
FIG. 2 is a fragmentary cross-sectional view of a connector housing showing the board lock exploded from the board holding device passageway within the housing and post with the housing exploded from a circuit board.
Figure 3:
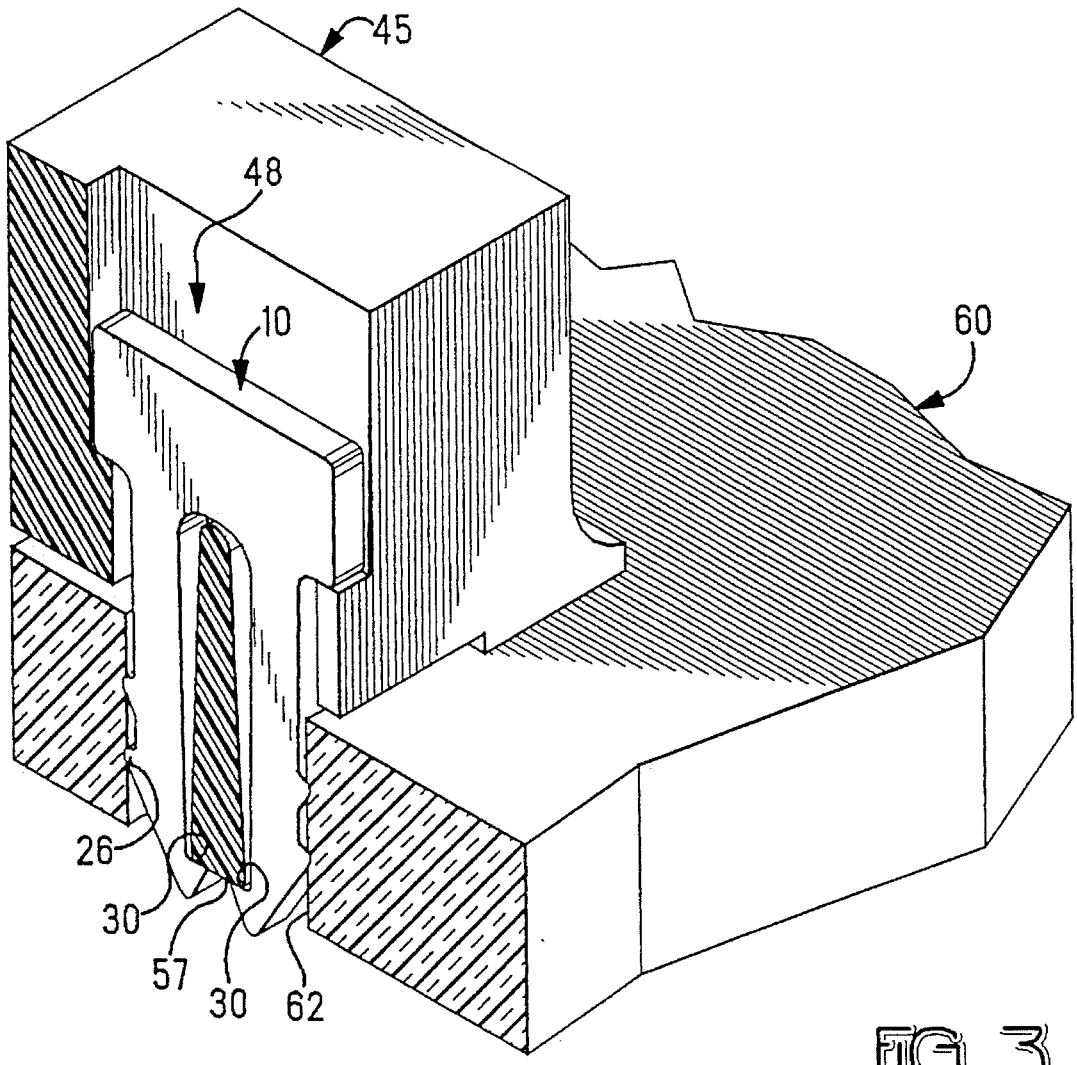
FIG. 3 is a cross-sectional view similar to that of FIG. 2 showing the holding device in locked engagement within the passageway and mounted in the circuit board.

Referring now to FIGS. 1, 2 and 3, the board lock or holding device 10 of the present invention is designed for holding an electrical connector 40 to a circuit board 60. Connector 40 includes a housing 42 having a mating face 44, a mounting face 46 and a device holding passageway 48 extending from a surface 47 opposed to the mounting face 46 and into a mounting post 50 extending from the mounting face 46 of housing 42. The connector 40 shown in FIG. 1 is a surface mounted connector using flexible film circuitry having circuit traces 43 at the leading film edges for interconnection to circuit pads 64 on circuit board 60. This connector is more fully disclosed in copending patent application U.S. Ser. No. 08/248,121, filed concomitantly herewith.

The mounting post on the illustrated connector includes a pair of semicylindrical legs 51 that are joined at 54 at least at the leading ends thereof and define slots 56 therebetween. Preferably the legs are joined along a tapered rib like section 54 which extends from the leading end 52 toward the mounting face 46 of housing 42 as can best be seen in FIG. 2.

Figure 5:
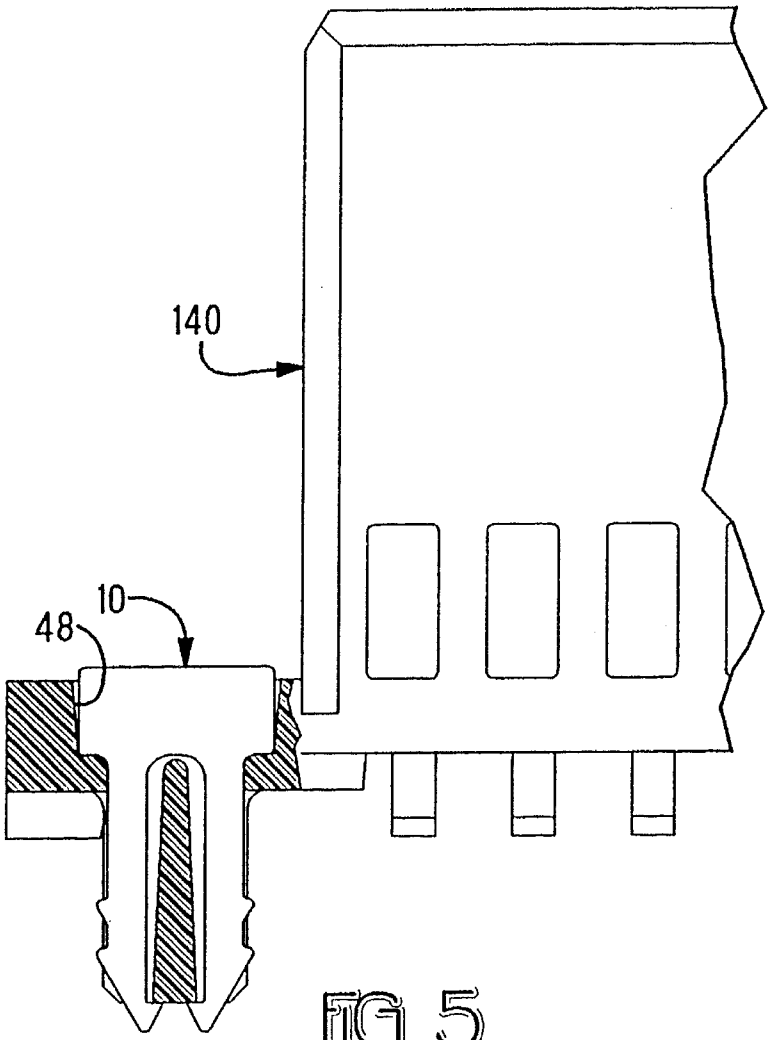
FIG. 5 is a view similar to that of FIG. 4 showing the board locking device in the housing of a surface mounted connector.
Figure 4:
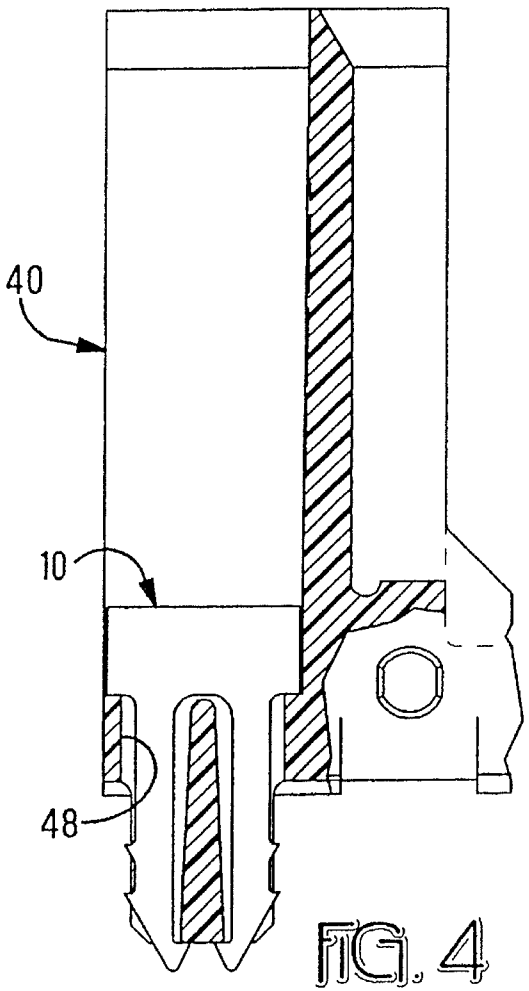
FIG. 4 is an enlarged fragmentary partially sectioned view of the device mounted in the housing of a card edge connector.

For purposes of illustrating the invention the holding device 10 is shown in FIGS. 2, 3, and 5, in a flange 45 of a connector, in FIG. 4 in the passageway 48 of a card edge connector 40 and in FIG. 5 in the passageway 48 of a surface mountable top loaded connector 140. It is to be understood that the holding device 10 can be used in any style of connector or other component being mounting to a circuit board.

The board lock or holding device 10 is a one-piece essentially planar metal member including a body 12 having opposed transverse edges 14 and end edges 16, and a pair of cantilevered beams 18 extending outwardly in a first direction in the plane from one of the transverse body edges 14 to free ends 24. The beams 18 have outer and inner edges 20,28, the inner edges 28 defining a slot 36 therebetween.

The inner edges 28 of beams 18 further include inwardly directed projections 30 defining latching sections at the leading ends 24 thereof for lockingly engaging the transverse leading end or locking surface 57 of the board mounting post 50 when the board lock device 10 is fully inserted into the board holding device passageway 48, as best seen in FIGS. 3 and 4. When inserted, body ends 15 of device 10 engage passageway stop surfaces 49. The inner beam edges 28 further have a lead-in surface 32 which slide along the tapered surfaces 53 of the rib like section 54 as the holding device 10 is inserted into passageway 48 thereby deflecting the beams 18 outwardly until the device 10 is fully seated in passageway 48, whereupon the projections or latching sections 30 engage the lower edge of rib section 54. Slot 36 is dimensioned to allow for compression of beams 18 during insertion into the board aperture 62 and to accommodate tolerance variations. Preferably the axial length of tapered rib section 54 is substantially equivalent to the axial length of slot 36 such that the innermost end 55 of rib 54 provides support along transverse edge 14 of device 10 intermediate the beams 18. The outer edges 20 of the beams 18 include a lead-in surface 22 at the free end 24 thereof and further include board locking barbs 26 extending outwardly from the outer edge.

As can also be seen in FIGS. 3, 4 and 5, the width of the semicylindrical legs 51 is narrower than that of the width of the beams 18 of board holding device 10 such that the board engaging barbs 26 along the outer edges of beams 18 extend transversely outwardly of the slots 56 in the mounting post 50 and engage the sides of the retention aperture 62 of circuit board 60 when the connector 40 is mounted to the board 60. If desired, retention apertures 62 of board 60 may be plated thereby allowing the board locking devices 10 to be soldered in circuit board 60, by means known in the art.

As shown in FIG. 1, in the preferred embodiment two of the holding devices 10 are used in the connector 40. When used in pairs, the leading ends 52 of the mounting posts 50 align the connector 40 to assure that the terminals or other conductors within the connector are in alignment with the corresponding circuits pads 64 on the circuit board.

When the connector 40 having the board lock devices 10 secured therein is mounted to a board 60, the lead-in surfaces 22 along the outer edge of the board lock device 10 and the edges of the mounting post 50 guide and align the connector 40 into position. As force is applied to mount the connector 40 to the board 60, the tapered surfaces 27 of the barbs 26 aid in deflecting the beams 18 further inwardly thereby increasing the self-retaining force of the board lock device 10. The locking notches 32 of beams 18 are pushed into the leading end 52 of ribbed portion 54, thus preventing backward movement of the board lock device 10 during connector mounting. No tool, therefore, is needed to backup the end of the board lock device 10 to force it into engagement in the board. The device 10 has sufficient latching or self-retaining force to remain secured within passageway 48 when inserted into board apertures within the standard range associated with standard board sizes.

In the preferred embodiment the holding device 10 is stamped from a sheet of metal stock of sufficient thickness and hardness to serve as a holding device by virtue of the barbs 26 thereon engaging the interior surface 62 of the board apertures. Materials such as brass, phosphor bronze, or stainless steel may be employed with the thicknesses ranging on the order of about 0.008 to 0.025 inches. The axial length of the device 10 depends upon dimensions of the passageway 48 and thickness of the board apertures such that the body portion 12 of the device 10 is held within the passageway 48 and the beams 18 extend into the bifurcated passageway portion of the mounting post 50.

Figure 6:
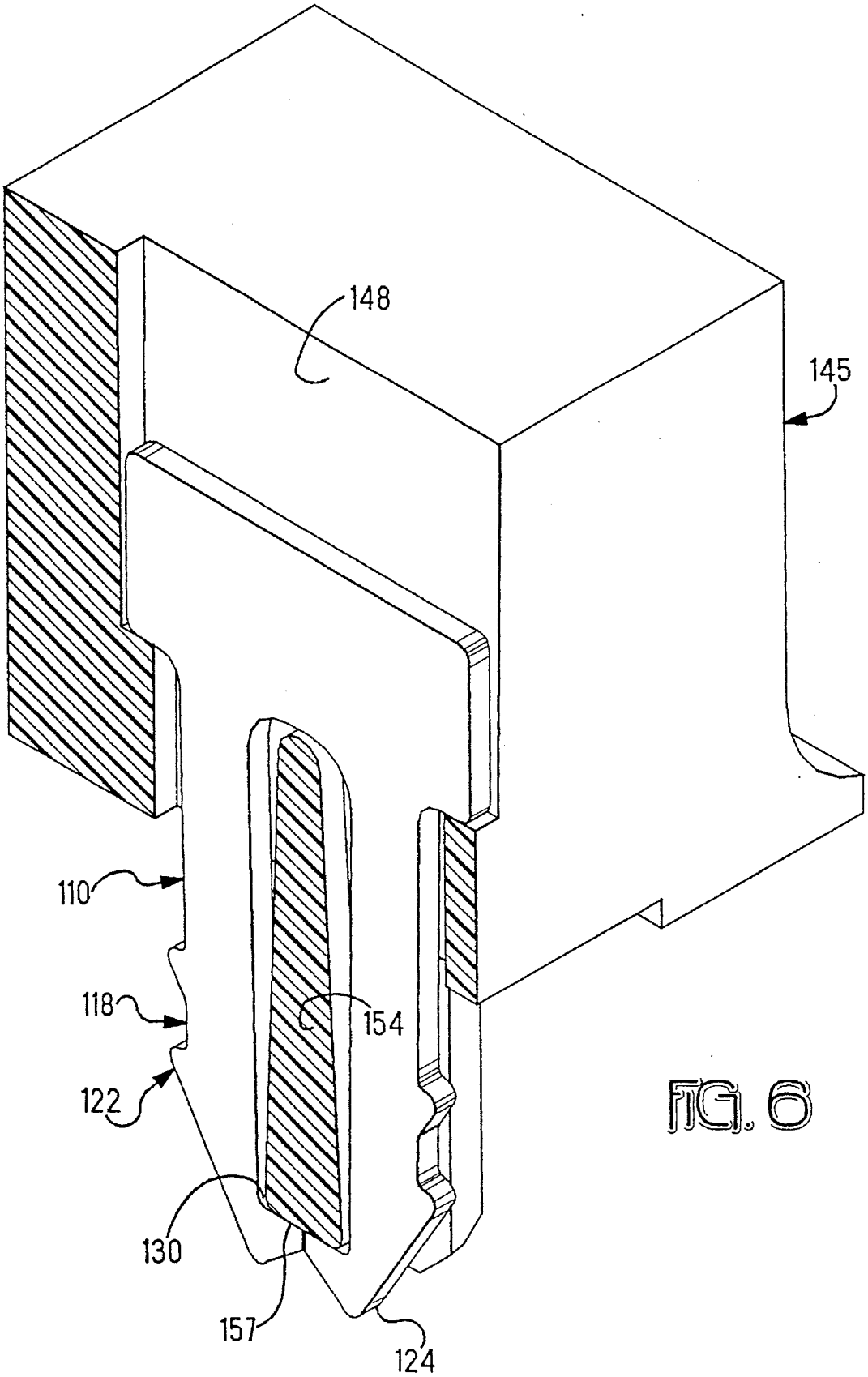
FIG. 6 is a view similar to that of FIG. 4, showing an enlarged fragmentary partially sectioned view of an alternate embodiment of the device mounted in the housing of a card edge connector.

FIG. 6 shows an alternative embodiment 110 of the invention that is particularly suitable for thinner stock materials. In this embodiment the leading ends of latching projections 130 are only minimally separated and extend along a greater portion of the leading end 157 of rib 154 than do the devices made of thicker stock, thereby providing essentially the same retention force as the device made from thicker stock.

The connector assembly of the present invention is cost effective to manufacture, since the configuration of the board lock device and the housing passageway and post in which the device is loaded permit the connector housing to be molded in a single draw mold using suitable materials as known in the art. Furthermore, the ability to top load the board lock device as well as terminal members into a connector housing facilitates the use of automated processes.

It is thought that the board mounting device and the electrical connector assembly of the present invention and many of its attended advantages will be understood from the foregoing description. It is apparent that various changes may be made in the form, construction and arrangement of parts thereof without departing from the spirit or scope of the invention or sacrificing all of its material advantages.

I claim:

1. A device for holding an electrical connector to a circuit board, said connector including a housing having a mating and a mounting face and at least one board mounting post extending from said mounting face for receipt into a retention aperture of a circuit board, said housing further including a board holding device passageway extending therethrough from a surface opposed to said mounting face and through said at least one board mounting post, said device comprising:

a one-piece essentially planar metal member including a body having opposed transverse and opposed end edges, said member being adapted to be received in said passageway of said connector housing; and a pair of cantilevered beams extending outwardly in a first direction in a plane of the metal member from one of said transverse body edges to free ends, said beams having outer and inner edges, said inner edges defining a slot therebetween, said board mounting post including a protrusion extending transversely at least into said passageway at least at a leading end thereof, said inner edges of said beams being adapted to enter into locking engagement with said protrusion upon full insertion of said device into said board holding device passageway and said outer beam edges including board holding portions that project beyond outer surfaces of said board mounting posts, said board holding portions bearing against sidewall surfaces of a circuit board aperture to hold said connector to said board when said connector has been fully mounted to said board; whereby after said device is secured within said housing, said locking engagement is sufficient to prevent any movement of said device in response to resistance to insertion of said board holding portions into said circuit board aperture when said connector is mounted to said circuit board.

2. The device of claim 1 wherein the inner edges of said beams include inner directed projections defining latching portions proximate free ends thereof which engage said transversely extending protrusion of said post.

3. An electrical connector assembly having at least two holding devices for securing said connector to a circuit board, said connector comprising:

a housing having mating and mounting faces and at least two board mounting posts extending from said mounting face for receipt into a retention aperture of a circuit board, said housing further including at least two board holding device passageways, each extending therethrough from a surface opposed to said mounting face and through a respective one of said at least two board mounting posts, each said post being a pair of semicylindrical legs joined at least at leading ends thereof to form a transversely extending locking surface, said semicylindrical legs defining slots therebetween at least along side portions at the leading ends thereof, each of said passageways being dimensioned to receive one of said at least two holding devices;

each of said holding device comprising:

a one-piece essentially planar metal member including a body having opposed transverse and opposed end edges, said member being adapted to be received in said passageway of said connector housing; and a pair of cantilevered beams extending outwardly in a first direction in a plane of the metal member from one of said transverse body edges to free ends, said beams having outer and inner edges, said inner edges defining a slot therebetween, said inner edges of said beams being adapted to enter into locking engagement with said transverse locking surface at said leading end of said post upon full insertion of said device into said board holding device passageway and said outer beam edges including board holding portions that project beyond outer surfaces of said board mounting posts, said board holding portions bearing against sidewall surfaces of a circuit board aperture to hold said connector to said board when said connector has been fully mounted to said board; whereby after said device is secured within said housing, said locking engagement is sufficient to prevent any movement of said device in response to resistance to insertion of said board holding portions into said circuit board aperture when said connector is mounted to said circuit board.

4. The connector assembly of claim 3 wherein said semicylindrical legs of said mounting post are joined by a rib-like portion extending from the leading end of the post toward the mating face of said housing.

5. The connector assembly of claim 4 wherein an axial length of said rib being essentially the same as an axial length of said slot between said beams of said board lock device.

6. The device of claim 3 wherein the inner edges of said beams include inner directed projections defining latching portions proximate free ends thereof which engage said transversely extending locking surface.

7. An electrical connector having at least one holding device for securing a connector to a circuit board, said connector comprising:

a housing having mating and mounting faces and at least one board mounting post extending from said mounting face for receipt into a retention aperture of a circuit board, said housing further including at least one board holding device passageway, each extending therethrough from a surface opposed to said mounting face and through a respective two board mounting post, each said post being a pair of semicylindrical legs joined at least at a leading end thereof to form a transversely extending locking surface, said semicylindrical leg defining slots therebetween at least along side portions at the leading end thereof, each said passageway being dimensioned to receive one holding device;

said holding device comprising:

a one-piece essentially planar metal member being adapted to be received in said passageway of said connector housing, said member including a body having;

a pair of cantilevered beams extending outwardly in a first direction in a plane of the metal member from a transverse body edge to free ends, said beams having outer and inner edges, said inner edges defining a slot therebetween, said inner edges of said beams being adapted to enter into locking engagement with said transverse locking surface at said leading end of said post upon full insertion of said device into said board holding device passageway and said outer beam edges including board holding portions that project beyond outer surfaces of said board mounting posts, said board holding portions bearing against sidewall surfaces of a circuit board aperture to hold said connector to said board when said connector has been fully mounted to said board; whereby after said device is secured within said housing, said locking engagement is sufficient to prevent any movement of said device in response to resistance to insertion of said board holding portions into said circuit board aperture when said connector is mounted to said circuit board.

8. The connector assembly of claim 7 wherein said semicylindrical legs of said mounting post are joined by a rib-like portion extending from the leading end of the post toward the mating face of said housing.

9. The connector assembly of claim 8 wherein an axial length of said rib is essentially the same as an axial length of said slot between said beams of said board lock device.

10. The device of claim 7 wherein the inner edges of said beams include inner directed projections defining latching portions proximate free ends thereof which engage said transversely extending locking surface.

* * * * *